US005458157A

United States Patent [19]

Solstad

[11] Patent Number: 5,458,157

[45] Date of Patent: Oct. 17, 1995

[54] TOOTHED WHEEL TYPE SHED FORMING DEVICE FOR SHUTTLE LOOM

[75] Inventor: Vidar Solstad, Sør-Audnedal, Norway

[73] Assignee: Mandals Reberbane Christiansen & Co. AS, Mandal, Norway

[21] Appl. No.: 337,396

[22] Filed: Nov. 8, 1994

[30] Foreign Application Priority Data

Nov. 8, 1993 [NO] Norway ..... 934029

[51] Int. Cl.[6] ..... D03D 37/00

[52] U.S. Cl. ..... 139/459; 139/55.1; 139/11; 139/15

[58] Field of Search ..... 139/459, 55.1, 139/11, 15

[56] References Cited

U.S. PATENT DOCUMENTS

| | | | |
|---|---|---|---|
| 2,517,215 | 8/1950 | Kronoff et al. | 139/439 |
| 2,609,838 | 9/1952 | Cole | 139/15 |
| 3,815,643 | 6/1974 | Haoya et al. | 139/15 |
| 4,977,933 | 12/1990 | Brais | 139/15 |
| 5,246,040 | 9/1993 | Barwick et al. | 139/439 |

*Primary Examiner*—Andy Falik
*Attorney, Agent, or Firm*—Bacon & Thomas

[57] ABSTRACT

A shed forming device for a shuttle loom includes a carrier (6) for at least one shuttle (5, 5') and a stationary frame (1) accommodating a reed of wires or dents (7) disposed in a plane extending parallel to the direction of movement of the shuttle carrier (6). A freely rotatable toothed wheel (4) is mounted on the shuttle carrier (6) in front of the corresponding shuttle, at an angle to the reed plane and in engagement with the reed wires or dents (7) to form a shuttle shed. The toothed wheel (4) is mounted on the opposite side of the reed plane with respect to the shuttle carrier to better accommodate the shuttle carrier.

1 Claim, 1 Drawing Sheet

TOOTHED WHEEL TYPE SHED FORMING DEVICE FOR SHUTTLE LOOM

BACKGROUND OF THE INVENTION

The present invention relates to weaving looms of the type comprising a carrier for at least one shuttle and a stationary frame carrying reed wires or dents positioned in a plane extending parallel to the direction of movement of the shuttle for the purpose of guiding the warp threads towards a point where the weft thread is to be inserted by means of the shuttle.

For introducing the weft threads, i.e. for passing the shuttle in the correct relationship to the individual warp threads, the warp threads must be separated so as to form a warp shed between them. A number of shed forming mechanisms for this purpose are of course known, one example being described in British Patent 1.351.059 and corresponding U.S. Pat. No. 3,815,643, in which the shed formation is effected by means of a freely rotatable toothed wheel carried by a shuttle carrier, the individual warp threads being received on the top of a tooth of said wheel or in the space between two such teeth.

BRIEF SUMMARY OF THE INVENTION

The present invention is aimed at a weaving loom of the character referred to, specifically of the circular type (but it may also be employed on looms of the flat type). According to the invention, the toothed wheel, also referred to as the shedding wheel, is positioned on the opposite side of the reed wires or dents with respect to the shuttle carrier. In such arrangement, there is space for more shuttles with less spacing between adjacent shuttles, and also space for larger weft spools, and because of the more compact structure it is possible to operate with higher weaving rates.

BRIEF DESCRIPTION OF THE DRAWINGS

The invention is illustrated by way of example with reference to the accompanying drawings, in which.

DESCRIPTION OF THE PREFERRED EMBODIMENT

Figure 1:
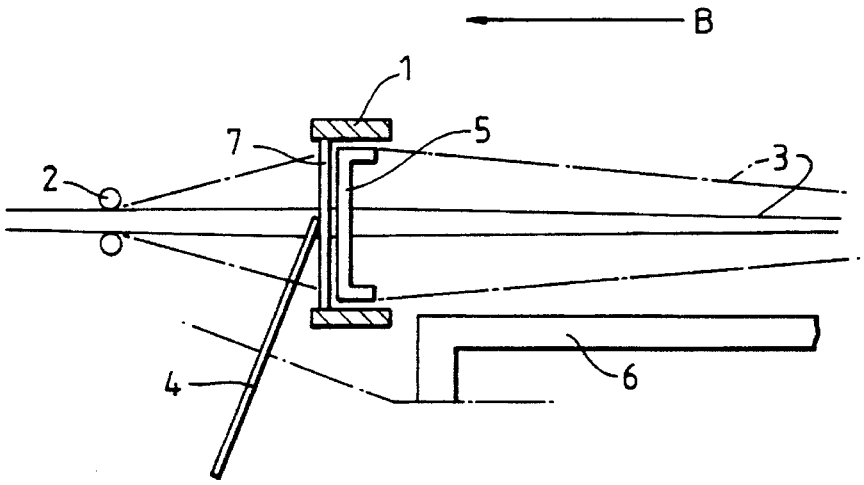
FIG. 1 illustrates in a side elevation view the arrangement of the toothed wheel and reed wires or dents relative to each other in a weaving loom, as seen in the direction of movement of the shuttle carrier (arrow A in FIG. 2)

In the drawing, reference 1 denotes the stationary frame of a weaving loom and reference 2 denotes a guide means for warp threads 3. A shuttle is indicated at 5. The shuttle spool proper is not shown, but the shuttle carrier is indicated at 6. The frame 1 accommodates a reed in the form of wires or dents 7 which are disposed parallel to one another and are located in a plane extending parallel to the direction of movement of the shuttle carrier 6. The reed serves to guide the warp threads 3 into a position to permit shedding and the introduction of the weft threads by means of the shuttle.

In order to provide the shed between the warp threads 3 for passage of the shuttle, the shuttle carrier 6 carries a freely rotatable toothed wheel 4 disposed at an angle to the reed plane. The teeth of the wheel 4 are arranged to engage the reed wires or dents 7 and, at the same time, individual warp threads will be received on the top of a tooth or in the spacing between adjacent teeth, such as described in the above British Patent. According to the present invention, the freely rotatable toothed wheel 4 is positioned on the opposite side of the reed with respect to the shuttle carrier 6.

Figure 2:
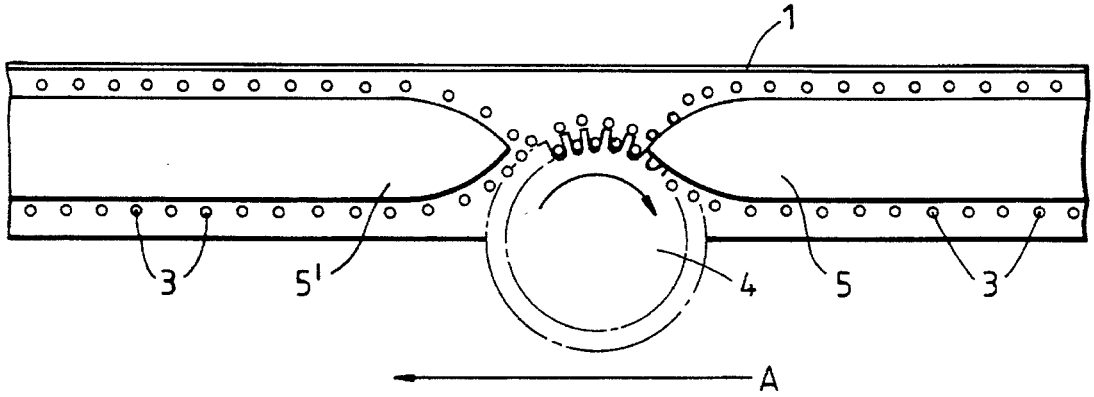
FIG. 2 is a view corresponding to that in FIG. 1, as seen in the direction of the arrow B in FIG. 1.

As is apparent from FIG. 2, in which the direction of movement of the shuttle is indicated by the arrow A, the toothed wheel 4 will rotate, due to the engagement with the reed wires or dents 7, with a speed which directly corresponds to the speed of the shuttle. The warp threads 3 are consequently not subjected to any side displacement relative to the wheel and also not to any undue tensioning.

It also appears from FIG. 2 that the toothed wheel 4 is mounted in front of the associated shuttle 5 and behind a preceding shuttle 5'. In a manner known per se the warp threads received on top of the teeth or in the spacing between adjacent teeth are guided over and under the shuttle, respectively, so as to form the shed for passage of the shuttle and shuttle spool. The shuttle is supported in any convenient manner with respect to the reed.

I claim:

1. In a weaving loom including a shuttle carrier for at least one shuttle and a stationary frame accommodating a reed of wires or dents disposed in a plane extending parallel to the direction of movement of the shuttle carrier for guiding the warp threads to a location where the weft thread is introduced by means of the shuttle, said shuttle carrier located to one side of the reed plane, a freely rotatable toothed wheel being mounted on the shuttle carrier in front of the corresponding shuttle, disposed at an angle to the reed plane and in engagement with the reed wires or dents to form a shuttle shed, the improvement wherein said toothed wheel is mounted on the opposite side of the reed plane with respect to said shuttle carrier.

* * * * *